US009017913B2

(12) United States Patent
Goan et al.

(10) Patent No.: US 9,017,913 B2
(45) Date of Patent: Apr. 28, 2015

(54) TONER FOR ELECTROSTATIC IMAGE DEVELOPMENT

(71) Applicant: Konica Minolta, Inc., Tokyo (JP)

(72) Inventors: Kazuyoshi Goan, Tokyo (JP); Mikio Kouyama, Tokyo (JP); Hajime Tadokoro, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/063,587

(22) Filed: Oct. 25, 2013

(65) Prior Publication Data

US 2014/0142267 A1 May 22, 2014

(30) Foreign Application Priority Data

Nov. 19, 2012 (JP) ..... 2012-253180

(51) Int. Cl.
*G03G 9/087* (2006.01)

(52) U.S. Cl.
CPC ..... *G03G 9/08706* (2013.01)

(58) Field of Classification Search
None
See application file for complete search history.

(56) References Cited

FOREIGN PATENT DOCUMENTS

| | | | |
|---|---|---|---|
| JP | 4267427 | B2 | 7/2004 |
| JP | 2007-57660 | A | 3/2007 |
| JP | 2012-247530 | | 12/2012 |

OTHER PUBLICATIONS

Machine translation of JP 2012-247530 A to Kamiyama et al. (Dec. 13, 2012).*

STN EIC Search Results (Sep. 12, 2014).*

Japanese Office Action, Official Notice of Reason for Refusal, Japanese Patent Application No. 2012-253180. Date of Delivery: Nov. 18, 2014 with English translation thereof (total 5 pages).

* cited by examiner

*Primary Examiner* — Vu A Nguyen
(74) *Attorney, Agent, or Firm* — Lucas & Mercanti, LLP

(57) ABSTRACT

A toner for electrostatic image development having sufficient low-temperature fixing properties, and excellent heat resistant storage stability and crush resistance is provided. In toner particles containing at least a binder resin, the binder resin contains a polymer having a structural unit represented by a general formula (1), wherein $R^1$, $R^2$, and $R^3$ each independently represent a hydrogen atom, a hydroxyl group, or an alkoxy group, or two adjacent groups of $R^1$, $R^2$, and $R^3$ combine to form —$O(CH_2)_iO$—, where i represents an integer of 1 or 2, provided that at least one of $R^1$, $R^2$, and $R^3$ is an alkoxy group, or two adjacent groups combine to form —$O(CH_2)_iO$—; and $R^4$ represents a hydrogen atom, a halogen atom, an alkyl group, a hydroxyl group, or an alkoxy group.

general formula (1)

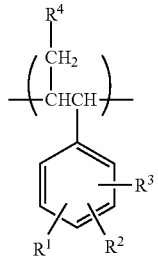

11 Claims, No Drawings

TONER FOR ELECTROSTATIC IMAGE DEVELOPMENT

CROSS REFERENCE TO RELATED APPLICATION

This Application claims the benefit of priority of Japanese Patent Application No. 2012-253180 filed on Nov. 19, 2012, which application is incorporated herein by reference in its entirety.

TECHNICAL FIELD

The present invention relates to a toner for electrostatic image development that is used in image formation of an electrophotographic system (hereinafter also simply referred to as "toner").

BACKGROUND ART

As examples of a resin material conventionally used for a toner, may be mentioned a polystyrene resin, a styrene-acrylic copolymer resin, a polyester resin, an epoxy resin, a butyral resin, and a hybrid resin such as a polyester resin having a grafted acrylic resin. Such a resin material is designed according to the application of a toner.

In particular, a resin material for a toner that is fixed with a heat roller requires improvement in fixing properties onto a recording medium and offset resistance. Conventionally, a macromolecular weight thermoplastic resin or a partially cross-linked thermoplastic resin has been mainly used.

Many efforts have been made to achieve a toner having excellent low-temperature fixing properties for high-speed and energy-saving printers and copiers. However, when the resin material as described above is used, a temperature at which a toner is fused and fixed (fixing temperature) needs to be set to be high, and it is difficult to save the energy.

In order to obtain a toner having a low fixing temperature, it is necessary to use a substance having a low melting temperature or a low melt viscosity as a resin material. Further, in order to obtain such a resin material, it is important that the resin material has a low glass transition temperature (Tg) or a low molecular weight.

However, such countermeasures additionally cause a problem where a toner has a low heat resistant storage stability (blocking resistance).

Therefore, it is essentially difficult that both the low-temperature fixing properties and the heat resistant storage stability are achieved.

In order to solve such a problem, a toner having a core particle of an amorphous resin and a coating surface of a crystalline polyester resin has been proposed (see Patent Literature 1).

However, the crystalline polyester resin is hard but fragile. In a vinyl-based resin such as a high general-purpose styrene-acrylic copolymer resin, the molecular weight needs to be low to achieve low-temperature fixing properties. In this case, sufficient crush resistance cannot be achieved.

When a toner is used as a two-component developer, the toner is generally mixed with a carrier such as iron powder within a developing device in a development step to generate electrostatic charge due to friction. When a fragile toner among the toners is used for a long time, the toner is broken due to friction with the carrier to produce a finer toner. The fine toner is likely to adhere to the surface of the carrier. Further, fusion of the finer toner to the carrier reduces the electric charge-imparting function of the carrier. Thus, the electric charge amount of the toner is reduced. As a result, the toner that is not charged sufficiently is scattered, to cause a problem of surface fogging on an image.

Patent Literature 2 has proposed a technique of achieving low-temperature fixing properties by mixing an amorphous resin with a crystalline resin with a low melting point to control the degree of compatibility.

However, when the compatibilization of the crystalline resin and the amorphous resin progresses, a mixed resin is plasticized, to cause a problem where sufficient heat resistant storage stability is not achieved.

CITATION LIST

Patent Literature

Patent Literature 1: Japanese Patent Application Laid-Open No. 2007-57660

Patent Literature 2: Japanese Patent No. 4267427

SUMMARY OF INVENTION

Technical Problem

The present invention has been made on the basis of the foregoing circumstances and has as its object the provision of a toner for electrostatic image development having sufficient low-temperature fixing properties, and excellent heat resistant storage stability and crush resistance.

Solution to Problem

In order to achieve the object, a toner for electrostatic image development according to one aspect of the present invention is a toner for electrostatic image development including toner particles containing at least a binder resin, wherein the binder resin contains a polymer having a structural unit represented by a general formula (1).

general formula (1)

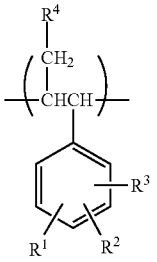

In the general formula (1), $R^1$, $R^2$, and $R^3$ each independently represent a hydrogen atom, a hydroxyl group, or an alkoxy group, or two adjacent groups of $R^1$, $R^2$, and $R^3$ combine to form —$O(CH_2)_iO$—, where i represents an integer of 1 or 2, provided that at least one of $R^1$, $R^2$, and $R^3$ is an alkoxy group, or two adjacent groups combine to form —$O(CH_2)_iO$—; and $R^4$ represents a hydrogen atom, a halogen atom, an alkyl group, a hydroxyl group, or an alkoxy group.

In the toner for electrostatic image development, it is preferable that the polymer is a copolymer having the structural unit represented by the above general formula (1) and a structural unit derived from a (meth)acrylate-based monomer. In the toner for electrostatic image development, the content of the structural unit represented by the above general formula (1) in the copolymer is preferably 40 to 90% by mass. The content of the structural unit derived from the (meth)acrylate-based monomer in the copolymer is preferably 10 to 40% by mass.

In the toner for electrostatic image development, it is preferable that the polymer is a copolymer having the structural unit represented by the above general formula (1), a structural unit derived from a (meth)acrylate-based monomer, and a structural unit derived from a styrene-based monomer.

In the toner for electrostatic image development, it is preferable that the structural unit represented by the above general formula (1) is represented by a formula (1-1).

formula (1-1)

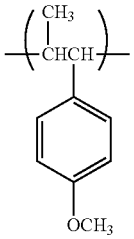

In the toner for electrostatic image development, the glass transition temperature is preferably 40 to 80° C., particularly preferably 40 to 65° C.

In the toner for electrostatic image development, the molecular weight of the polymer is preferably 1,500 to 60,000.

In the toner for electrostatic image development, it is preferable that at least one of $R^1$, $R^2$, and $R^3$ in the above general formula (1) is an alkoxy group and the bonding site thereof is a para position.

In the toner for electrostatic image development, it is preferable that $R^4$ in the above general formula (1) is a hydrogen atom or a methyl group.

Advantageous Effects of Invention

According to the toner for electrostatic image development, the binder resin contains a polymer having a structural unit represented by the general formula (1). Therefore, the toner has sufficient low-temperature fixing properties, and excellent heat resistant storage stability and crush resistance.

DESCRIPTION OF EMBODIMENTS

Hereinafter, the present invention will be described in detail.

Toner:

The toner of the present invention includes toner particles containing a binder resin containing a polymer (hereinafter also referred to as "specific polymer") having a structural unit (hereinafter also referred to as "specific structural unit") represented by the above-described general formula (1). The toner particles may further contain a colorant, a magnetic powder, a parting agent, a charge control agent, and the like, if necessary. Further, an external additive such as a flow agent and a cleaning aid may be added to the toner particles.

In the general formula (1) representing the specific structural unit, $R^1$, $R^2$, and $R^3$ each independently represent a hydrogen atom, a hydroxyl group, or an alkoxy group, or two adjacent groups of $R^1$, $R^2$, and $R^3$ combine to form —O$(CH_2)_i$O—, wherein represents an integer of 1 or 2, provided that at least one of $R^1$, $R^2$, and $R^3$ is an alkoxy group, or two adjacent groups combine to form —O$(CH_2)_i$O—.

Examples of the alkoxy group selected as $R^1$, $R^2$, and $R^3$ may include a methoxy group, an ethoxy group, an n-propoxy group, an isopropozy group, an n-buthoxy group, a sec-buthoxy group, and a tert-butoxy group.

In particular, from the viewpoint of imparting low-temperature fixing properties, it is preferable that at least one of $R^1$, $R^2$, and $R^3$ is an alkoxy group and the bonding site thereof is a para position to a group represented by a following formula (a) that is bonded to an aromatic ring.

In the general formula (1), $R^4$ represents a hydrogen atom, a halogen atom, an alkyl group, a hydroxyl group, or an alkoxy group.

Examples of the halogen atom selected as $R^4$ may include a chlorine atom, a bromine atom, and an iodine atom. Examples of the alkyl group selected as $R^4$ may include an alkyl group which may be branched, such as a methyl group, an ethyl group, an n-propyl group, an isopropyl group, an n-butyl group, an isobutyl group, a sec-butyl group, and a tert-butyl group, and a cyclic alkyl group such as a cyclopentyl group and a cyclohexyl group. Examples of an alkoxy group selected as $R^4$ may include a methoxy group, an ethoxy group, an n-propoxy group, an isopropozy group, an n-buthoxy group, a sec-buthoxy group, and a tert-butoxy group. In particular, from the viewpoint of polymerization reactivity, $R^4$ is preferably a hydrogen atom or a methyl group.

The specific structural unit is particularly preferably represented by the above formula (1-1) (derived from anethole as described below).

formula (a)

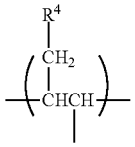

As described below, the specific structural unit is introduced into the specific polymer through a polymerization reaction, particularly a radical polymerization reaction using a polymerizable monomer represented by a general formula (2) (hereinafter also referred to as "specific monomer").

general formula (2)

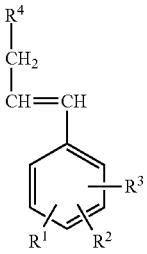

In the general formula (2), $R^1$, $R^2$, and $R^3$ each independently represent a hydrogen atom, a hydroxyl group, or an alkoxy group, or two adjacent groups of $R^1$, $R^2$, and $R^3$ combine to form —O$(CH_2)_i$O—, wherein i represents an integer of 1 or 2, provided that at least one of $R^1$, $R^2$, and $R^3$ is an alkoxy group, or two adjacent groups combine to form —$O(CH_2)_tO$—; and $R^4$ represents a hydrogen atom, a halogen atom, an alkyl group, a hydroxyl group, or an alkoxy group.

In particular, from the viewpoint of imparting low-temperature fixing properties, it is preferable that at least one of $R^1$, $R^2$, and $R^3$ is an alkoxy group and the bonding site thereof is a para position to a —CH=$CHCH_2R^4$ group bonded to an aromatic ring. From the viewpoint of polymerization reactivity, $R^4$ is preferably a hydrogen atom or a methyl group.

In the present invention, a plant-based monomer can be used as the specific monomer. This is preferable since the amount of discharged carbon dioxide, which causes the global warming, can be finally reduced. Examples of the specific plant-based monomer may include anethole included in an anise oil, an star anise oil, a fennel oil, a magnolia kobus oil, and the other oil. Further, an artificially synthesized monomer may be used as the specific monomer.

As an extraction method of anethole, a crystallize method in which an essential oil is chiefly cooled to precipitate anethole is known. In order to artificially synthesize the specific monomer, for example, a method described in U.S. Patent Application Publication No. 2012/0010298 may be adopted.

Concrete examples of the specific monomer may include monomers represented by following formulae (2-1) to (2-5). The above-described anethole is represented by the following formula (2-1).

These specific monomers may be used either singly or in any combination thereof.

formula (2-1)

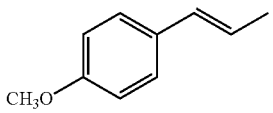

formula (2-2)

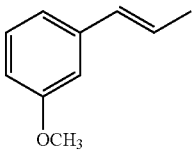

formula (2-3)

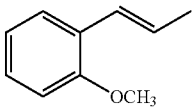

formula (2-4)

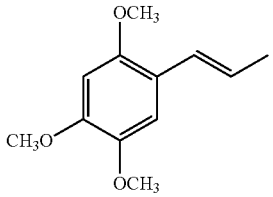

formula (2-5)

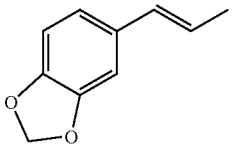

The specific polymer may be a homopolymer having only the specific structural unit or a copolymer having the specific structural unit and a structural unit derived from another polymerizable monomer (hereinafter also referred to as "specific copolymer"). From the viewpoint of stabilization of toner function, the specific polymer is preferably the specific copolymer.

Examples of the other polymerizable monomer capable of forming the specific copolymer may include a (meth)acrylate-based monomer, a styrene-based monomer, and a polymerizable monomer having an ionic leaving group. In particular, from the viewpoint of stabilization of thermophysical properties, the specific copolymer is preferably a copolymer having the specific structural unit and a structural unit derived from a (meth)acrylate-based monomer. Further, from the viewpoint of stabilization of polymerization reaction, the specific copolymer is preferably a copolymer having the specific structural unit, a structural unit derived from a (meth)acrylate-based monomer, and a structural unit derived from a styrene-based monomer.

Concrete examples of the (meth)acrylate-based monomer may include an acrylate derivative such as methyl acrylate, ethyl acrylate, n-butyl acrylate, isopropyl acrylate, isobutyl acrylate, t-butyl acrylate, n-octyl acrylate, 2-ethylhexyl acrylate, cyclohexyl acrylate, stearyl acrylate, lauryl acrylate, phenyl acrylate, dimethylaminoethyl acrylate, and diethylaminoethyl acrylate; and a methacrylate derivative such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, cyclohexyl methacrylate, stearyl methacrylate, lauryl methacrylate, phenyl methacrylate, dimethylaminoethyl methacrylate, and diethylaminoethyl methacrylate. Among these, n-butyl acrylate and 2-ethylhexyl acrylate are preferably used. These monomers may be used either singly or in any combination thereof.

Concrete examples of the styrene-based monomer may include styrene and a derivative thereof such as styrene, o-methylstyrene, m-methylstyrene, p-methylstyrene, α-methylstyrene, β-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. Among these, styrene is preferably used. These monomers may be used either singly or in any combination thereof.

The ionic leaving group is a substituent such as a carboxyl group, a sulfonic acid group, and a phosphoric acid group. Concrete examples of the polymerizable monomer having an ionic leaving group may include acrylic acid, methacrylic acid, maleic acid, itaconic acid, fumaric acid, styrenesulfonic acid, and acrylamide propyl sulfonic acid. Among these, acrylic acid and methacrylic acid are preferably used. These monomers may be used either singly or in any combination thereof.

The content (copolymerization ratio) of the specific structural unit in the specific copolymer is preferably 40 to 90% by mass.

When the content of the specific structural unit in the specific copolymer falls within the above-described range, excellent heat resistant storage stability and crush resistance can be surely attained while the low-temperature fixing properties can be sufficiently achieved.

When the specific copolymer has the specific structural unit and a structural unit derived from a (meth)acrylate-based monomer, the content (copolymerization ratio) of the structural unit derived from the (meth)acrylate-based monomer is preferably 10 to 40% by mass.

When the specific copolymer has the specific structural unit and a structural unit derived from a styrene-based monomer, the content (copolymerization ratio) of the structural unit derived from the styrene-based monomer is preferably 20 to 40% by mass.

The glass transition temperature of the specific polymer is preferably 40 to 80° C., more preferably 40 to 65° C.

When the glass transition temperature of the specific polymer falls within the above-described range, the low-temperature fixing properties can be sufficiently achieved.

In the present invention, the glass transition temperature of the specific polymer can be measured with a differential scanning calorimeter "DSC-7" (manufactured by PerkinElmer Co., Ltd.).

Specifically, 4.5 mg of measurement sample (specific polymer) is enclosed in a pan made of aluminum "KIT NO. 0219-0041," and the pan is placed in a sample holder of the "DSC-7."

An empty pan made of aluminum is used for reference measurement. The temperature in a heating-cooling-heating cycle is controlled under measurement conditions of a measurement temperature of 0° C. to 200° C., a temperature increasing rate of 10° C./min, and a temperature decreasing rate of 10° C./min. The analysis is based on data in the second heating. As the glass transition temperature, the intersection of the extension of a base line before the rising edge of a first endothermic peak and a tangential line representing the maximum inclination between the rising edge of the first peak and the top of the peak is used. During increasing the temperature in the first heating, the sample is held at 200° C. for 5 minutes.

The peak molecular weight of the specific polymer constituting the toner of the present invention is determined from the molecular weight distribution in terms of styrene that is measured by gel permeation chromatography (GPC), and is preferably 1,500 to 60,000, more preferably 3,000 to 40,000.

When the molecular weight of the specific polymer falls within the above-described range, the thermophysical properties can be easily controlled.

The peak molecular weight used herein means a molecular weight at the elution time of the top of the peak of the molecular weight distribution. When the molecular weight distribution has a plurality of peaks, the peak molecular weight means a molecular weight at the elution time of the top of a peak having the largest peak area ratio.

In the present invention, the peak molecular weight of the specific polymer is measured by the gel permeation chromatography (GPC). Specifically, the peak molecular weight is measured with an apparatus "HLC-8220" (manufactured by TOSOH Corporation) and a column "TSK guard column+ TSK gel Super HZ-M (three in series)" (manufactured by TOSOH Corporation) while the temperature of the column is held at 40° C. and tetrahydrofuran (THF) used as a carrier solvent flows at a flow rate of 0.2 ml/min. In contrast, the measurement sample (specific polymer) is dissolved in tetrahydrofuran at a concentration of 1 mg/ml by a treatment using an ultrasonic dispenser at room temperature for 5 minutes. Subsequently, the solution is treated through a membrane filter having a pore size of 0.2 μm to obtain a sample solution. 10 μL of the sample solution and the above-described carrier solvent are injected into the apparatus. Detection is performed using a refractive index detector (RI detector), and the molecular weight distribution of the measurement sample is calculated using a calibration curve determined using monodispersed polystyrene standard particles. Ten kinds of polystyrene are used for the determination of the calibration curve.

The binder resin constituting the toner of the present invention may be composed only of the specific polymer or may be a mixture of the specific polymer and another resin. In the binder resin, the ratio of the content of the specific polymer to the content of the other resin is preferably 40:60 to 90:10.

When the specific structural unit as a copolymer component is incorporated into the binder resin, the content of the specific structural unit, as a composition ratio of mass of the polymerizable monomer as a raw material, is preferably 20 to 1.00% by mass, more preferably 25 to 90% by mass.

When the content of the specific structural unit in the binder resin falls within the above-described range, excellent heat resistant storage stability and crush resistance can be surely attained while the low-temperature fixing properties can be sufficiently achieved.

The content of the specific structural unit in the binder resin can be controlled by adjusting the content (copolymerization ratio) of the specific structural unit in the specific copolymer, adjusting the content of the specific polymer in the binder resin, and a combination thereof.

Colorant:

When the toner particles according to the present invention contain a colorant, commonly known dye and pigment can be used as the colorant.

Examples of a colorant used to obtain a black toner may include carbon black, a magnetic substance, and iron-titanium complex oxide black. Examples of carbon black may include channel black, furnace black, acetylene black, thermal black, and lamp black. Examples of a magnetic substance may include ferrite and magnetite.

Examples of a colorant used to obtain a yellow toner may include dyes such as C.I. Solvent Yellow: 19, 44, 77, 79, 81, 82, 93, 98, 103, 104, 112, and 162; and pigments such as C.I. Pigment Yellow: 14, 17, 74, 93, 94, 138, 155, 180 and 185.

Examples of a colorant used to obtain a magenta toner may include dyes such as C.I. Solvent Red: 1, 49, 52, 58, 63, 111, and 122; and pigments such as C.I. Pigment Red: 5, 48:1, 53:1, 57:1, 122, 139, 144, 149, 166, 177, 178, and 222.

Examples of a colorant used to obtain a cyan toner may include dyes such as C.I. Solvent Blue: 25, 36, 60, 70, 93, and 95; and pigments such as C.I. Pigment Blue: 1, 7, 1.5, 60, 62, 66, and 76.

As a colorant used to obtain a toner of each color, the colorants for each color may be used singly or in any combination thereof.

The content of the colorant in the toner particles is preferably 0.5 to 20% by mass, more preferably 2 to 10% by mass.

Magnetic Powder:

When the toner particles according to the present invention contain a magnetic powder, for example, magnetite, y-hematite, or various types of ferrites may be used as the magnetic powder.

The content of the magnetic powder in the toner particles is preferably 10 to 500% by mass, more preferably 20 to 200% by mass.

Parting Agent:

When the toner particles according to the present invention contain a parting agent, the parting agent is not particularly limited, and various known waxes can be used. Examples of waxes may include polyolefin such as low molecular polypropylene, low molecular polyethylene, low molecular oxidized polypropylene, low molecular oxidized polyethylene, paraffin, and a synthesis ester wax. In particular, a synthesis ester wax is preferably used since it has a low melting point and a low viscosity. As a synthesis ester wax, behenyl behenate, glycerol tribehenate, or pentaerythritol tetrabehenate is particularly preferably used.

The content of the parting agent in the toner particles is preferably 1 to 30% by mass, more preferably 3 to 15% by mass.

Charge Control Agent:

When the toner particles according to the present invention contain a charge control agent, the charge control agent is not particularly limited as long as it is a colorless material that can impart positive or negative charge by frictional electrification. Various known charge control agents for positive electrification and charge control agents for negative electrification can be used.

The content of the charge control agent in the toner particles is preferably 0.01 to 30% by mass, more preferably 0.1 to 10% by mass.

The glass transition temperature of the toner of the present invention is preferably 40 to 80° C., more preferably 40 to 65° C.

The softening point of the toner of the present invention is preferably 80 to 110° C., more preferably 90 to 105° C.

In the present invention, the glass transition temperature of the toner is measured in the same manner as in the above-described measurement process of the glass transition temperature of the specific polymer except that a toner is used instead of the measurement sample.

In the present invention, the softening point of the toner is measured as follows.

First, 1.1 g of measurement sample (toner) is placed in a petri dish under an environment of 20° C. and 50% RH and then is leveled off. The measurement sample is allowed to stand for 12 hours or longer, and is then pressurized using a press "SSP-10A" (manufactured by Shimadzu Corporation) at a pressure of 3,820 kg/cm$^2$ for 30 seconds to produce a cylindrical, molded sample having a diameter of 1 cm. This molded sample is then extruded with a flow tester "CFT-500D" (manufactured by Shimadzu Corporation) under an environment of 24° C. and 50% RH under conditions of a load of 196 N (20 kgf), a starting temperature of 60° C., a preheating time of 300 seconds, and a temperature increasing rate of 6° C./min through a hole (1 mm in diameter×1 mm) of a columnar die using a piston having a diameter of 1 cm after completion of preheating. An offset method temperature $T_{offset}$ is measured by setting an offset value to 5 mm in a melting temperature measuring method using a temperature increasing method, and is used as the softening point of the toner.

Average Particle Diameter:

The average particle diameter of the toner particles constituting the toner of the present invention is preferably 4 to 10 μm, more preferably 6 to 9 μm, for example, in terms of a volume-based median diameter.

When the volume-based median diameter falls within the above-described range, the transfer efficiency is increased, and the quality of a halftone image is improved, resulting in an improvement in the image quality of fine lines and dots.

In the present invention, the volume-based median diameter of the toner is measured and calculated using a measuring device in which a computer system (manufactured by Beckman Coulter, Inc.) is connected to "Coulter Muitisizer TA-III" (manufactured by Beckman Coulter, Inc.) and equipped with a data processing software "Software V3.51."

Specifically, 0.02 g of measurement sample (toner) is added to 20 mL of surfactant solution (e.g., a surfactant solution obtained by diluting a neutral detergent containing a surfactant component ten folds with pure water for the purpose of dispersing the toner particles) and blended, and ultrasonic dispersion is then performed for 1 minute to prepare a dispersion of the toner. The toner dispersion is added with a pipette to a beaker containing "ISOTON II" (manufactured by Beckman Coulter, Inc.) held in a sample stand until the concentration displayed by the measuring device reaches 8%.

Here, when the concentration is controlled to this range, a reproducible measured value can be obtained. In the measuring device, the number of particles to be measured is counted as 25,000, an aperture diameter is adjusted to 50 μm, and a range of 1 to 30 μm, which is a measurement range, is divided into 256, to calculate frequency values. A particle diameter of 50% from the larger integrated volume fraction is used as a volume-based median diameter.

Average Circularity:

In the toner of the present invention, the average circularity of the individual toner particles constituting the toner is preferably 0.950 to 0.980 from the viewpoint of improving a transfer efficiency.

The average circularity of the toner is a value measured with "FPIA-2100" (manufactured by SYSMEX CORPORATION). Specifically, the average circularity of the toner is obtained as follows. A measurement sample (toner) is wetted with an aqueous solution containing a surfactant, and subjected to a ultrasonic dispersion treatment for 1 minute to disperse the measurement sample. The measurement sample is photographed under conditions of a high-magnification imaging (HPF) mode using "FPIA-2100" (manufactured by SYSMEX CORPORATION) at a proper concentration in which the HPF detection number is 3,000 to 10,000. The circularities of the individual toner particles are calculated in accordance with a following general formula (T). The circularities of the respective toner particles are all added, and the obtained value is divided by the total number of the toner particles to obtain the average circularity of the toner. When the HPF detection number falls within the above-described range, reproducibility is obtained.

Circularity=(Peripheral length of circle having the same projected area as in image of particle)/(Peripheral length of projected image of the particle). Formula (T)

According to the toner as described above, the binder resin contains the polymer having the structural unit represented by the general formula (1), so that the toner has sufficient low-temperature fixing properties, and excellent heat resistant storage stability and crush resistance.

When the specific monomer is considered as an alternative of a styrene-based monomer such as a styrene-acrylic copolymer resin, a polymer having the specific structural unit has rigidity of a main chain due to a substituent at a side chain of the specific structural unit. Further, in a configuration capable of obtaining the same low-temperature fixing properties as in the styrene-acrylic copolymer resin, the entire molecular weight can be kept large. Therefore, the low-temperature fixing properties are sufficiently attained, excellent heat resistant storage stability is imparted, and excellent crush resistance is also imparted. Accordingly, it is assumed that toner scattering is suppressed.

According to the toner as described above, a monomer derived from a plant, such as anethole, can be used as the specific monomer for forming the specific polymer, to reduce the environmental impact.

Production Process of Toner:

A production process of the toner of the present; invention is not particularly limited. Examples of the process may include a kneading-pulverizing process, a suspension polymerization process, an emulsion aggregation process, an emulsion polymerization aggregation process, a mini-emulsion polymerization aggregation process, and other known processes. Particularly, from the viewpoint of reducing energy cost during production, it is preferable to use an emulsion polymerization aggregation process, wherein emulsion polymerization or mini-emulsion polymerization is performed in an aqueous medium using the specific monomer to prepare fine particles of a binder resin containing a polymer having the specific structural unit (hereinafter be referred to as "binder resin fine particles"), and the binder resin fine particles and if necessary, fine particles of other toner particle forming components are then aggregated and fused. A production process of a toner using a suspension polymerization process disclosed in Japanese Patent Application Laid-Open No. 2010-191043 can also be preferably adopted.

In the emulsion polymerization aggregation process, the binder resin fine particles may have a structure of two or more layers of binder resins having respective different compositions. In this case, a multi-stage polymerization process may be adopted. In the process, a polymerization initiator and a polymerizable monomer are added to a dispersion of first resin fine particles prepared by an emulsion polymerization treatment (first-stage polymerization) according to a method known per se in the art, and the prepared system is subjected to a polymerization treatment (second-stage polymerization).

A concrete example of production steps used when the toner of the present invention is obtained by the emulsion polymerization aggregation process is as follows:

(1A) a binder resin fine particle polymerizing step of activating a radical polymerization initiator in an aqueous medium with a polymerizable monomer that forms a binder resin to obtain binder resin fine particles;

(1B) a colorant fine particle dispersion preparing step of optionally preparing a dispersion of fine particles of a colorant (hereinafter also referred to as "colorant fine particles");

(2) an association step of adding an aggregating agent to the aqueous medium containing the binder resin fine particles and the colorant fine particles, promoting salt precipitation, and at the same time, performing aggregating and fusing, to form associated particles;

(3) an aging step of controlling the shape of the associated particles to form a toner;

(4) a filtrating and washing step of separating the toner particles from the aqueous medium by filtration and removing a surfactant and the like from the toner particles;

(5) a drying step of drying the washed toner particles; and (6) an external additive adding step of adding an external additive to the dried toner particles.

The term "aqueous medium" used herein means a medium including 50 to 100% by mass of water and 0 to 50% by mass of a water-soluble organic solvent. Examples of the water-soluble organic solvent may include methano, ethanol, isopropanol, butanol, acetone, methyl ethyl ketone, and tetrahydrofuran. An alcohol-based organic solvent that does not dissolve the obtained resin, such as methanol, ethanol, isopropanol, and butanol, is preferably used.

When the toner particles according to the present invention contain a parting agent, as examples of a method of introducing the parting agent into the toner particles, may be mentioned a method of forming binder resin fine particles containing the parting agent and a method in which a dispersion obtained by dispersing parting agent fine particles in an aqueous medium is added in the association step of forming the toner particles and the binder resin fine particles, the colorant fine particles, and the parting agent fine particles are then subjected to salt precipitation, aggregation, and fusion. These methods may be combined.

When the toner particles according to the present invention contain a charge control agent, as examples of a method of introducing the charge control agent into the toner particles, may be mentioned methods similar to the above-described methods of introducing the parting agent into the toner particles.

(1A) Binder Resin Fine Particle Polymerizing Step:

Specifically, in the binder resin fine particle polymerizing step, the specific monomer and if necessary, another desired polymerizable monomer are added to an aqueous medium and dispersed therein by applying mechanical energy to form oil droplets. In this state, the specific monomer and the other polymerizable monomer are subjected to a radical polymerization reaction to form binder resin fine particles having a size of about 50 to about 300 nm, for example, in terms of a volume-based median diameter.

A dispersing device used to apply the mechanical energy for the formation of oil droplets is not particularly limited. Representative examples of the dispersing device may include a commercially available stirring device "CLEARMIX" (manufactured by M Technique Co., Ltd.) equipped with a rotor rotatable at high speed. In addition to the above-described stirring device equipped with a rotor rotatable at high speed, a device such as an ultrasonic dispersing device, a mechanical homogenizer, a Manton-Gaulin homogenizer, and a pressure-type homogenizer can be used.

The temperature required for the radical polymerization reaction depends on the kinds of the used monomers and the radical polymerization initiator, and for example, is preferably 50 to 100° C., more preferably 55 to 90° C. The time required for the radical polymerization reaction depends on the kinds of the used monomers and the reaction rate of the radicals from the radical polymerization initiator, and for example, is preferably 2 to 12 hours.

Dispersion Stabilizer:

In the binder resin fine particle polymerizing step, an appropriate dispersion stabilizer may be added to stably disperse the fine particles in the aqueous medium.

Examples of the dispersion stabilizer may include tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina. Further, a substance generally used as a surfactant, such as polyvinyl alcohol, gelatin, methyl cellulose, sodium dodecyl benzene sulfonate, an ethylene oxide adduct, or higher alcohol sodium sulfate, may be used as a dispersion stabilizer.

Various conventionally known ionic surfactants and nonionic surfactants can be used as the surfactant.

Examples of the ionic surfactant may include sulfonates such as sodium dodecyl benzene sulfonate, sodium arylalkyl polyether sulfonate, sodium 3,3-disulfonediphenyl urea-4,4-diazo-bis-amino-8-naphthol-6-sulfonate, ortho-carboxybenzene-azo-dimethylaniline, and sodium 2,2,5,5-tetramethyltriphenylmethane-4,4-diazo-bis-β-naphthol-6-sulfonate; sulfates such as sodium dodecylsulfate, sodium tetradecylsulfate, sodium pentadecylsulfate, and sodium octylsulfate; and fatty acid salts such as sodium oleate, sodium laurate, sodium caprate, sodium caprylate, sodium caproate, potassium stearate, and calcium oleinate.

Examples of the nonionic surfactant may include polyethylene oxide, polypropylene oxide, combination of polypropylene oxide and polyethylene oxide, alkylphenol polyethylene oxide, an ester of higher fatty acid and polyethylene glycol, an ester of higher fatty acid and polypropylene oxide, and a sorbitan ester.

Polymerization Initiator:

In the binder resin fine particles polymerizing step, as a polymerization initiator used in polymerization of the specific monomer, a water-soluble polymerization initiator such as potassium persulfate, ammonium persulfate, and azobiscyanovaleric acid; a water-soluble redox polymerization initiator such as hydrogen peroxide-ascorbic acid; and an oil-soluble polymerization initiator such as azobisisobutyronitrile and azobisvaleronitrile can be used.

Chain Transfer Agent:

In the binder resin fine particle polymerizing step, a commonly used chain transfer agent can be used to control the molecular weight of the specific polymer or the binder resin. The chain transfer agent is not particularly limited. Examples of the chain transfer agent may include n-octylmercaptan, n-dodecylmercaptan, tert-dodecylmercaptan, and tetrachloromethane.

(1B) Colorant Fine Particle Dispersion Preparing Step:

The colorant fine particle dispersion preparing step is optionally performed when toner particles containing a colorant are desired. In this step, the colorant is dispersed in a fine particle form in an aqueous medium to prepare a dispersion of the colorant fine particles.

The colorant can be dispersed using mechanical energy.

The dispersed colorant fine particles have a volume-based median diameter of preferably 10 to 300 nm, more preferably 100 to 200 nm, particularly preferably 100 to 150 nm.

The volume-based median diameter of the colorant fine particles is measured with an electrophoretic light-scattering photometer "ELS-800" (manufactured by Otsuka Electronics Co., Ltd.).

The association step (2) to the external additive adding step (6) can be performed according to any of various conventionally known methods.

Aggregating Agent:

The aggregating agent used in the association step is not particularly limited, but an aggregating agent selected from a metal salt is suitably used. As examples of the metal salt, may be mentioned a monovalent metal salt such as a salt of alkali metal such as sodium, potassium, and lithium; a salt of divalent metal such as calcium, magnesium, manganese, and copper; and a salt of trivalent metal such as iron and aluminum. Concrete examples of the metal salt may include sodium chloride, potassium chloride, lithium chloride, calcium chloride, magnesium chloride, zinc chloride, copper sulfate, magnesium sulfate, and manganese sulfate. Among these, the bivalent metal salt is particularly preferably used since the aggregation can proceed by a smaller amount. These metal salts may be used either singly or in any combination thereof.

External Additive:

The toner particles can form the toner of the present invention as they are. However, in order to improve flowability, electrification, cleaning properties, and the like, an external additive such as a flowability improver and a cleaning aid, which are so-called post treatment agents, may be added to the toner particles to form the toner of the present invention.

Examples of the external additive may include an inorganic oxide fine particle such as a silica fine particle, an alumina fine particle, and a titanium oxide fine particle, an inorganic stearic acid compound fine particle such as an aluminum stearate fine particle and a zinc stearate fine particle, and an inorganic titanic acid compound fine particle such as a strontium titanate fine particle and a zinc titanate fine particle. These external additives may be used either singly or in any combination thereof.

It is preferable that the inorganic fine particles have been subjected to a surface treatment with a silane coupling agent, a titanium coupling agent, a higher fatty acid, or silicone oil, to improve heat resistant storage stability and to improve environmental stability.

The total content of these various external additives is preferably 0.05 to 5 parts by mass, preferably 0.1 to 3 parts by mass per 100 parts by mass of the toner particles. Various external additives may be used in combination.

Developer:

The toner of the present invention may be used as a magnetic or non-magnetic one-component developer, but may also be mixed with a carrier to be used as a two-component developer.

When the toner is used as a two-component developer, the amount of the toner mixed with the carrier is preferably 2 to 10% by mass.

A mixer used to mix the toner and the carrier is not particularly limited, and examples thereof may include a nauta mixer and W-cone and V-shape mixers.

As the carrier, magnetic particles formed of a conventionally known material including metal such as iron, ferrite, and magnetite, and an alloy of the metal with metal such as aluminum and lead can be used. In particular, it is preferable that the carrier is ferrite particles.

In addition, a coated carrier obtained by coating the surface of magnetic particles with a coating agent such as a resin and a binder-type carrier obtained by dispersing magnetic fine powder in a binder resin can be used as the carrier.

A coating resin constituting the coated carrier is not particularly limited, and examples thereof may include an olefin-based resin, a styrene-based resin, a styrene-acrylic copolymer resin, a silicone resin, an ester resin, and a fluororesin. A resin constituting the resin dispersion-type carrier is not particularly limited, and a known resin can be used. For example, a styrene-acrylic copolymer resin, a polyester resin, a fluororesin, and a phenol resin can be used.

The volume-based median diameter of carrier particles constituting the carrier is preferably 20 to 100 μm, more preferably 20 to 60 μm.

The volume-based median diameter of the carrier can be measured typically with a laser diffraction-type particle size distribution measuring device "HELOS" (manufactured by SYMPATEC Corp.) equipped with a wet dispersing device.

Image Forming Method:

The toner of the present invention can be suitably used in an image forming method including a fixing step according to a thermal pressure fixation procedure capable of applying pressure and heat. In particular, the toner can be suitably used in an image forming method in which the fixing temperature in the fixing step is a surface temperature of a heating member in a fixing nip portion, and is as comparatively low as 80 to 110° C., preferably 80 to 95° C.

Further, the toner can be suitably used in an image forming method capable of fixing at high speed in which the fixing linear velocity is 200 to 600 mm/sec.

In the image forming method, specifically, the toner as described above is used, and an electrostatic latent image formed on a photoreceptor is developed to get a toner image. This toner image is transferred to an image support, and the toner image transferred to the image support is then fixed by a fixing treatment of the thermal pressure fixation procedure, to obtain a print image on which a visible image is formed.

Image Support:

Concrete examples of the image support used in the image forming method using the toner of the present invention may include, but not limited to, various coated printing papers including a plain paper such as a thin paper and a thick paper, a high-quality paper, an art paper, and a coated paper, and various printing papers such as a commercially available Japanese paper and a commercially available postcard paper.

The embodiments of the present invention have been specifically described above. However, the embodiments of the present invention are not limited to the above-described examples, and various changes or modifications may be added thereto.

EXAMPLES

Hereinafter, Examples of the present invention will be specifically described, but the present invention is not limited to these Examples.

Synthesis Example 1 of Specific Monomer

In a Pyrex (registered trademark) tube replaced with argon, 148.0 mg (1.0 mmol) of potassium allyl trifluoroborate, 46.8 mg (0.25 mmol) of 4-bromoanisole, 104.0 mg (0.75 mmol; of $K_2CO_3$, and 5.0 mg (0.0075 mmol) of $PdCl_2$ (dtbpf) were placed. 2.5 mL of isopropanol/water (2/1) solution was then added, and the tube was sealed with a rubber plug. The tube was irradiated with an ultrasonic wave at 120° C. for 30 minutes.

To the resulting reactant, ammonium chloride and ethyl ether were added, and an ether phase was separated. The resulting reaction mixture was purified by thin layer chromatography using hexane as an eluant, washed with ethyl ether, filtrated, and dried to obtain a specific monomer represented by the above formula (2-1) (hereinafter referred to as "specific monomer [1]").

Synthesis Example 2 of Specific Monomer

A specific monomer represented by the above formula (2-2) (hereinafter referred to as "specific monomer [2]") was obtained in the same manner as in Synthesis Example 1 except that 4-bromoanisole was changed into 3-bromoanisole.

Synthesis Example 3 of Specific Monomer

A specific monomer represented by the above formula (2-3) (hereinafter referred to as "specific monomer [3]") was obtained in the same manner as in Synthesis Example 1 except that 4-bromoanisole was changed into 2-bromoanisole.

Synthesis Example 4 of Specific Monomer

A specific monomer represented by the above formula (2-4) (hereinafter referred to as "specific monomer [4]") was obtained in the same manner as in Synthesis Example 1 except that 46.8 mg (0.25 mmol) of 4-bromoanisole was changed into 61.8 mg (0.25 mmol) of 1-bromo-2,4,5-trimethoxybenzene.

Synthesis Example 5 of Specific Monomer

A specific monomer represented by the above formula (2-5) (hereinafter referred to as "specific monomer [5]") was obtained in the same manner as in Synthesis Example 1 except that 46.8 mg (0.25 mmol) of 4-bromoanisole was changed into 50.3 mg (0.25 mmol) of 5-bromo-1,3-benzodioxsol.

Production Example 1 of Toner (1) Preparation of Resin Particle Dispersion (a) First-Stage Polymerization A reaction vessel equipped with a stirrer, a temperature sensor, a condenser, and a nitrogen inlet device was charged with a surfactant solution prepared by dissolving 4 parts by mass of sodium polyoxyethylene (2) dodecyl ether sulfate in 3,000 parts by mass of ion-exchanged water, and an internal temperature was increased to 80° C. with stirring at a stirring rate of 230 rpm under a nitrogen stream.

To the surfactant solution, an initiator solution prepared by dissolving 5 parts by mass of polymerization initiator (potassium persulfate: KPS) in 200 parts by mass of ion-exchanged water was added, and the liquid temperature was adjusted to 75° C. A monomer mixed solution of 624 parts by mass of specific monomer [1], 176 parts by mass of butyl acrylate, and 68 parts by mass of methacrylic acid was added dropwise for 1 hour. This system was heated and stirred for 2 hours at 75° C. to cause polymerization, thereby preparing a resin fine particle dispersion [1a].

(b) Second-Stage Polymerization:

A monomer mixed solution of 147 parts by mass of specific monomer [1], 42 parts by mass of butyl acrylate, 20 parts by mass of methacrylic acid, 0.5 parts by mass of n-octylmercaptan, and 82 parts by mass of "WEP-5" (available from NOF CORPORATION) was mixed and dispersed for 1 hour with a mechanical dispersing machine "CLEARMIX"

(manufactured by M Technique Co., Ltd.), to prepare an emulsion dispersion [1b] containing emulsion particles.

A reaction vessel equipped with a stirrer, a temperature sensor, a condenser, and a nitrogen inlet device was charged with a surfactant solution prepared by dissolving 2 parts by mass of sodium polyoxyethylene (2) dodecyl ether sulfate in 1,270 parts by mass of ion-exchanged water, and the temperature was adjusted to 80° C. After then, the resin fine particle dispersion [1a] was added in an amount of 40 parts by mass in terms of solid content, the liquid temperature was adjusted to 80° C., and the emulsion dispersion [b]) was added. To this solution, an initiator solution prepared by dissolving 5 parts by mass of polymerization initiator (potassium persulfate: KPS) in 100 parts by mass of ion-exchanged water was added. This system was heated and stirred for 1 hour at 80° C. to cause polymerization, thereby preparing a resin fine particle dispersion [1] containing a polymer having a molecular weight of 47,000.

(2) Preparation of Colorant Fine Particle Dispersion

While a solution obtained by adding 27 parts by mass of sodium n-dodecyl sulfate to 500 parts by mass of ion-exchanged water was stirred, 30 parts by mass of carbon black as a colorant was gradually added. The mixture was dispersed with a mechanical dispersing machine "CLEARMIX" (manufactured by M TECHNIQUE CO., LTD.), to prepare a colorant fine particle dispersion [1].

(3) Formation of Toner Particles

In a reaction vessel equipped with a temperature sensor, a condenser, a nitrogen inlet device, and a stirrer, 1,250 parts by mass of resin fine particle dispersion [1], 2,000 parts by mass of ion-exchanged water, and 165 parts by mass of colorant fine particle dispersion [1] were placed and stirred to prepare a solution for association. The inner temperature of the solution for association was adjusted to 30° C., and 5 mol/L of aqueous sodium hydroxide solution was added to adjust the pH to 10.0. An aqueous solution prepared by dissolving 52.6 parts by mass of magnesium chloride hexahydrate in 72 parts by mass of ion-exchanged water was then added over 10 minutes at 30° C. under stirring. The resultant mixture was allowed to stand for 3 minutes, and heating was then started to raise the temperature of this system to 90° C. over 6 minutes (temperature increasing rate: 10° C./min).

In this state, the particle diameter of associated particles was measured with "Multisizer 3" (manufactured by Coulter Beckmann. Co.). At the time when the volume-based median diameter reached 6.7 μm, an aqueous solution prepared by dissolving 115 parts by mass of sodium chloride in 700 parts by mass of ion-exchanged water was added to stop the growth of the particles. The solution was further heated and stirred at a liquid temperature of 90° C.±2° C. for 6 hours to continue the fusion bonding. The circularity of the associated particles was measured with "FPIA-2100" (manufactured by SYSMEX CORPORATION) and found to be 0.958.

The solution was cooled to 30° C. at 6° C./min, and the associated particles were separated by filtration, repeatedly washed with ion-exchanged water at 45° C., and dried by hot air at 40° C., to obtain toner particles [1].

(4) Addition of External Additive

To 100 parts by mass of the toner particles [1], an external additive including 1.0 part by mass of silica (number average primary particle diameter: 12 nm, degree of hydrophobization: 68) treated with hexamethylsilazane and 0.3 parts by mass of titanium dioxide (number average primary particle diameter: 20 nm, degree of hydrophobization: 63) treated with n-octylsilane was added, the mixture was subjected to an external additive treatment with a "Henschel mixer" (manufactured by Mitsui Miike Machinery Co., Ltd.) to prepare a black toner [1].

The external additive treatment with the Henschel mixer was performed under conditions of a peripheral speed of stirring blade of 35 m/sec, a treatment temperature of 35° C., and a treatment time of 15 minutes.

Production Examples 2 and 3 of Toner

Toners [2] and [3] were each produced in the same manner as in Production Example 1 of the toner except that the amounts of the specific monomer [1] and butyl acrylate to be added in (1) Preparation of resin fine particle dispersion were changed into those shown in Table 1.

TABLE 1

| | FIRST-STAGE POLYMERIZATION | | SECOND-STAGE POLYMERIZATION | | | COPOLYMER RATIO (BY MASS) | |
|---|---|---|---|---|---|---|---|
| TONER NO. | SPECIFIC MONOMER[1] (PART BY MASS) | BA (PART BY MASS) | SPECIFIC MONOMER[1] (PART BY MASS) | BA (PART BY MASS) | MOLECULAR WEIGHT OF POLYMER | SPECIFIC MONOMER[1] | BA |
| [1] | 624 | 176 | 147 | 42 | 47,000 | 78 | 22 |
| [2] | 664 | 136 | 157 | 32 | 50,000 | 83 | 17 |
| [3] | 704 | 96 | 166 | 23 | 49,000 | 88 | 12 |

* BA MEANS BUTYL ACRYLATE

Production Examples 4 to 6 of Toner

Toners [4] to [6] were each produced in the same manner as in Production Example 1 of the toner except that the specific monomer [1] was changed into the specific monomer [2] and the amounts of the specific monomer [2] and butyl acrylate to be added were changed into those shown in Table 2 in (1) Preparation of resin fine particle dispersion.

TABLE 2

| TONER NO. | FIRST-STAGE POLYMERIZATION SPECIFIC MONOMER[2] (PART BY MASS) | FIRST-STAGE POLYMERIZATION BA (PART BY MASS) | SECOND-STAGE POLYMERIZATION SPECIFIC MONOMER[2] (PART BY MASS) | SECOND-STAGE POLYMERIZATION BA (PART BY MASS) | MOLECULAR WEIGHT OF POLYMER | COPOLYMER RATIO (BY MASS) SPECIFIC MONOMER[2] | COPOLYMER RATIO (BY MASS) BA |
|---|---|---|---|---|---|---|---|
| [4] | 624 | 176 | 147 | 42 | 48,000 | 78 | 22 |
| [5] | 664 | 136 | 157 | 32 | 49,000 | 83 | 17 |
| [6] | 704 | 96 | 166 | 23 | 48,000 | 88 | 12 |

* BA MEANS BUTYL ACRYLATE

Production Examples 7 to 9 of Toner

Toners [7] to [9] were each produced in the same manner as in Production Example 1 of the toner except that the specific monomer [1] was changed into the specific monomer (3] and the amounts of the specific monomer [3] and butyl acrylate to be added were changed into those shown in Table 3 in (1) Preparation of resin fine particle dispersion.

TABLE 3

| TONER NO. | FIRST-STAGE POLYMERIZATION SPECIFIC MONOMER[3] (PART BY MASS) | FIRST-STAGE POLYMERIZATION BA (PART BY MASS) | SECOND-STAGE POLYMERIZATION SPECIFIC MONOMER[3] (PART BY MASS) | SECOND-STAGE POLYMERIZATION BA (PART BY MASS) | MOLECULAR WEIGHT OF POLYMER | COPOLYMER RATIO (BY MASS) SPECIFIC MONOMER[3] | COPOLYMER RATIO (BY MASS) BA |
|---|---|---|---|---|---|---|---|
| [7] | 624 | 176 | 147 | 42 | 48,000 | 78 | 22 |
| [8] | 664 | 136 | 157 | 32 | 49,000 | 83 | 17 |
| [9] | 704 | 96 | 166 | 23 | 50,000 | 88 | 12 |

* BA MEANS BUTYL ACRYLATE

Production Examples 10 to 12 of Toner

Toners [10] to [22] were each produced in the same manner as in Production Example 1 of the toner except that the specific monomer [1] was changed into the specific monomer [4] and the amounts of the specific monomer [4] and butyl acrylate to be added were changed into those shown in Table 4 in (1) Preparation of resin fine particle dispersion.

TABLE 4

| TONER NO. | FIRST-STAGE POLYMERIZATION SPECIFIC MONOMER[4] (PART BY MASS) | FIRST-STAGE POLYMERIZATION BA (PART BY MASS) | SECOND-STAGE POLYMERIZATION SPECIFIC MONOMER[4] (PART BY MASS) | SECOND-STAGE POLYMERIZATION BA (PART BY MASS) | MOLECULAR WEIGHT OF POLYMER | COPOLYMER RATIO (BY MASS) SPECIFIC MONOMER[4] | COPOLYMER RATIO (BY MASS) BA |
|---|---|---|---|---|---|---|---|
| [10] | 600 | 200 | 141 | 48 | 48,000 | 75 | 25 |
| [11] | 640 | 160 | 151 | 38 | 50,000 | 80 | 20 |
| [12] | 680 | 120 | 160 | 29 | 50,000 | 85 | 15 |

* BA MEANS BUTYL ACRYLATE

Production Examples 13 to 15 of Toner

Toners [13] to [15] were each produced in the same manner as in Production Example 1 of the toner except that the specific monomer [1] was changed into the specific monomer [5] and the amounts of the specific monomer [5] and butyl acrylate to be added were changed into those shown in Table 5 in (1) Preparation of resin fine particle dispersion.

TABLE 5

| TONER NO. | FIRST-STAGE POLYMERIZATION SPECIFIC MOMOMER[5] (PART BY MASS) | FIRST-STAGE POLYMERIZATION BA (PART BY MASS) | SECOND-STAGE POLYMERIZATION SPECIFIC MONOMER[5] (PART BY MASS) | SECOND-STAGE POLYMERIZATION BA (PART BY MASS) | MOLECULAR WEIGHT OF POLYMER | COPOLYMER RATIO (BY MASS) SPECIFIC MONOMER[5] | COPOLYMER RATIO (BY MASS) BA |
|---|---|---|---|---|---|---|---|
| [13] | 640 | 160 | 151 | 38 | 47,500 | 80 | 20 |
| [14] | 680 | 120 | 160 | 29 | 49,000 | 85 | 15 |
| [15] | 720 | 80 | 170 | 19 | 49,000 | 90 | 10 |

* BA MEANS BUTYL ACRYLATE

Production Examples 16 to 19 of Toner

Toners [16] to [19] were each produced in the same manner as in Production Example 1 of the toner except that part of the specific monomer [1] was changed into styrene and the amounts of the specific monomer [1], styrene, and butyl acrylate to be added were changed into those shown in Table 6 in (1) Preparation of resin fine particle dispersion.

TABLE 6

| TONER NO. | FIRST-STAGE POLYMERIZATION SPECIFIC MONOMER[1] (PART BY MASS) | FIRST-STAGE POLYMERIZATION STYRENE (PART BY MASS) | FIRST-STAGE POLYMERIZATION BA (PART BY MASS) | SECOND-STAGE POLYMERIZATION SPECIFIC MONOMER[1] (PART BY MASS) | SECOND-STAGE POLYMERIZATION STYRENE (PART BY MASS) | SECOND-STAGE POLYMERIZATION BA (PART BY MASS) | MOLECULAR WEIGHT OF POLYMER | COPOLYMER RATIO (BY MASS) SPECIFIC MONOMER[1] | COPOLYMER RATIO (BY MASS) STYRENE | COPOLYMER RATIO (BY MASS) BA |
|---|---|---|---|---|---|---|---|---|---|---|
| [16] | 400 | 200 | 200 | 84 | 47 | 48 | 49,000 | 50 | 25 | 25 |
| [17] | 400 | 240 | 160 | 84 | 57 | 38 | 50,300 | 50 | 30 | 20 |
| [18] | 400 | 280 | 120 | 84 | 66 | 29 | 49,500 | 50 | 35 | 15 |
| [19] | 200 | 480 | 120 | 47 | 113 | 29 | 50,000 | 25 | 60 | 15 |

* BA MEANS BUTYL ACRYLATE

Production Examples 20 to 22 of Toner

Toners [20] to [22] were each produced in the same manner as in Production Example 1 of the toner except that the specific monomer [1] was changed into styrene and the amounts of styrene and butyl acrylate to be added were changed into those shown in Table 7 in (1) Preparation of resin fine particle dispersion.

TABLE 7

| TONER NO. | FIRST-STAGE POLYMERIZATION STYRENE (PART BY MASS) | FIRST-STAGE POLYMERIZATION BA (PART BY MASS) | SECOND-STAGE POLYMERIZATION STYRENE (PART BY MASS) | SECOND-STAGE POLYMERIZATION BA (PART BY MASS) | MOLECULAR WEIGHT OF POLYMER | COPOLYMER RATIO (BY MASS) STYRENE | COPOLYMER RATIO (BY MASS) BA |
|---|---|---|---|---|---|---|---|
| [20] | 600 | 200 | 142 | 47 | 49,000 | 75 | 25 |
| [21] | 640 | 160 | 151 | 38 | 51,000 | 80 | 20 |
| [22] | 680 | 120 | 161 | 28 | 49,000 | 85 | 15 |

* BA MEANS BUTYL ACRYLATE

Measurement of Glass Transition Temperature:

The glass transition temperature (Tg) of each of the obtained toners [1] to [22] was measured with a differential scanning calorimeter "DSC-7" (manufactured by PerkinElmer Co., Ltd.).

Specifically, 4.5 mg of measurement sample (toner) was sealed in a pan made of aluminum "KIT NO. 0219-0041," and the pan was placed in a sample holder of the "DSC-7." An empty pan made of aluminum was used for reference measurement. The temperature in a heating-cooling-heating cycle was controlled under measurement conditions of a measurement temperature of 0° C. to 200° C., a temperature increasing rate of 10° C./min, and a temperature decreasing rate of 10° C./min. The analysis was performed on the basis of data in the second heating. As the glass transition temperature, the intersection of the extension of a base line before the rising edge of a first endothermic peak and a tangential line representing the maximum inclination between the rising edge of the first peak and the top of the peak was used. During increasing the temperature in the first heating, the sample was held at 200° C. for 5 minutes.

Production Examples 1 to 22 of Developer

A ferrite carrier coated with a silicone resin and having a volume-based median diameter of 60 μm was mixed in each of the toners [1] to [22] with a V-shape mixer so that the toner concentration was 6% by mass, to produce developers [1] to [22].

Examples 1 to 19 and Comparative Examples 1 to 3

(1) Evaluation of Low-Temperature Fixing Properties

A commercially available copy machine "bizhub PRO C6500" (manufactured by Konica Minolta Business Technologies, Inc.) was modified so that the surface temperature of a heat roller in the fixing device was able to be changed from 120 to 170° C. at an interval of 5° C. The modified machine was used to repeatedly perform a fixing test in which a solid image of 1.5 cm×1.5 cm (amount of a toner applied: 2.0 mg/cm$^2$) was fixed to an A4-size high-quality paper (64 g/m$^2$) under an environment of ordinary temperature (20° C.) and ordinary humidity (55% RH) while the fixing temperature (surface temperature of the heat roller) was changed so as to be increased from 120° C., 125° C. . . . at an interval of 5° C.

The solid image obtained in each fixing test was folded at the center, and the peelability of the image was visually observed. The lowest fixing temperature in the fixing tests in which the image was not peeled at all was used as a lower limit fixing temperature. When the lower limit fixing temperature is lower than 150° C., no practical problem is caused, and so the toner is judged to be acceptable. The results are shown in Table 8.

(2) Evaluation of Heat Resistant Storage Stability 10 g of each of the toners [1] to [22] was weighed in a cup made of propylene, and allowed to stand under an environment of 50° C. and 50% RH for 15 hours. The blocking (aggregated) state was then evaluated in accordance with the following evaluation criteria. The results are shown in Table 8.

Evaluation Criteria

A: When the cup is only inclined, the toner flows easily.

B: When the cup continues to be moved for a period of time, the toner is generally collapsed and begins to flow (causing no practical problem).

C: Aggregation occurs. Even when an aggregate is prodded with a pointed object, the toner is solidified (causing a practical problem).

(3) Evaluation of Toner Scattering

Each of the developers [1] to [22] was set in a commercially available copy machine "bizhub PRO C6500" (manufactured by Konica Minolta Business Technologies, Inc.), and 500,000 sheets of white paper were printed under an environment of high temperature (30° C.) and high humidity (80% RH). The scattering state of the toner in the machine and surface fogging of printed matter were visually observed. The toner is evaluated in accordance with the following evaluation criteria. The results are shown in Table 8.

Evaluation Criteria

A: The inside of the machine is not contaminated with the toner.

B: Toner scattering is slightly observed in the machine (causing no practical problem).

C: Toner scattering is remarkable and surface fogging of printed matter begins to be increased (causing a practical problem).

D: Toner scattering is extremely increased and maintenance of the machine is required (causing a practical problem)

TABLE 8

| | DEVELOPER NO. | TONER NO. | GLASS TRANSITION TEMPERATURE (° C.) | LOW-TEMPERATURE FIXING PROPERTIES (° C.) | HEAT RESISTANT STORAGE STABILITY | TONER SCATTERING |
|---|---|---|---|---|---|---|
| EXAMPLE1 | [1] | [1] | 40 | 120 | A | A |
| EXAMPLE2 | [2] | [2] | 54 | 120 | A | A |
| EXAMPLE3 | [3] | [3] | 65 | 125 | A | A |
| EXAMPLE4 | [4] | [4] | 40 | 120 | A | B |
| EXAMPLE5 | [5] | [5] | 54 | 125 | A | A |
| EXAMPLE6 | [6] | [6] | 65 | 125 | A | A |
| EXAMPLE7 | [7] | [7] | 40 | 120 | A | B |
| EXAMPLE8 | [8] | [8] | 54 | 125 | A | B |
| EXAMPLE9 | [9] | [9] | 65 | 125 | A | A |
| EXAMPLE10 | [10] | [10] | 40 | 130 | A | B |
| EXAMPLE11 | [11] | [11] | 54 | 135 | A | B |
| EXAMPLE12 | [12] | [12] | 64 | 135 | A | B |
| EXAMPLE13 | [13] | [13] | 40 | 120 | A | A |
| EXAMPLE14 | [14] | [14] | 55 | 120 | A | A |
| EXAMPLE15 | [15] | [15] | 65 | 125 | A | A |
| EXAMPLE16 | [16] | [16] | 41 | 130 | A | B |
| EXAMPLE17 | [17] | [17] | 50 | 130 | A | B |
| EXAMPLE18 | [18] | [18] | 61 | 135 | A | B |
| EXAMPLE19 | [19] | [20] | 62 | 135 | A | B |
| COMPARATIVE EXAMPLE1 | [20] | [20] | 40 | 140 | C | D |
| COMPARATIVE EXAMPLE2 | [21] | [21] | 54 | 140 | C | C |
| COMPARATIVE EXAMPLE3 | [22] | [22] | 64 | 145 | B | C |

As seen from the results, the toner according to each of Examples 1 to 19 was confirmed to have sufficient low-temperature fixing properties, and excellent heat resistant storage stability by using a polymer having the specific structural unit as the binder resin. Further, since the toner according to each of Examples 1 to 19 has crush resistance, it is considered that occurrence of toner scattering is suppressed.

The invention claimed is:

1. A toner for electrostatic image development, comprising toner particles containing at least a binder resin, wherein the binder resin contains a polymer having a structural unit represented by a general formula (1), general formula (1)

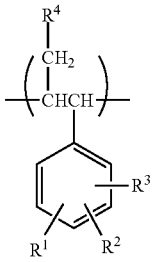

wherein $R^1$, $R^2$, and $R^3$ each independently represent a hydrogen atom, a hydroxyl group, or an alkoxy group, or two adjacent groups of $R^1$, $R^2$, and $R^3$ combine to form —O $(CH_2)_i$O—, where i represents an integer of 1 or 2, provided that at least one of $R^1$, $R^2$, and $R^3$ is an alkoxy group, or two adjacent groups combine to form —O$(CH_2)_i$O—; and $R^4$ represents a hydrogen atom, a halogen atom, an alkyl group, a hydroxyl group, or an alkoxy group.

2. The toner for electrostatic image development according to claim 1, wherein the polymer is a copolymer having the structural unit represented by the general formula (1) and a structural unit derived from a (meth)acrylate-based monomer.

3. The toner for electrostatic image development according to claim 1, wherein the polymer is a copolymer having the structural unit represented by the general formula (1), a structural unit derived from a (meth)acrylate-based monomer, and a structural unit derived from a styrene-based monomer.

4. The toner for electrostatatic image development according to claim 1, wherein the structural unit represented by the general formula (1) is represented by a formula (1-1), formula (1-1)

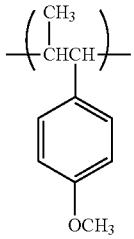

5. The toner for electrostatic image development according to claim 1, having a glass transition temperature of 40 to 80°C.

6. The toner for electrostatic image development according to claim 1, wherein the polymer has a peak molecular weight of 1,500 to 60,000.

7. The toner for electrostatic image development according to claim 1, wherein at least one of $RI^1$, $R^2$, and $R^3$ in the general formula (1) is an alkoxy group and a bonding site thereof is a para position.

8. The toner for electrostatic image development according to claim 1, wherein $R^4$ in the general formula (1) is any of a hydrogen atom and a methyl group.

9. The toner for electrostatic image development according to claim 2, wherein the structural unit represented by the general formula (1) is contained in an amount of 40 to 90% by mass in the copolymer.

10. The toner for electrostatic image development according to claim 2, wherein the structural unit derived from the (meth)acrylate-based monomer is contained in an amount of 10 to 40% by mass in the copolymer

11. The toner for electrostatic image development according to claim 1, having a glass transition temperature of 40 to 65°C.

* * * * *